US007686639B2

(12) United States Patent
Ma et al.

(10) Patent No.: US 7,686,639 B2
(45) Date of Patent: Mar. 30, 2010

(54) ELECTRICAL CARD CONNECTOR HAVING CLIPS TO INCREASE RETAINING FORCE FOR CARDS

(75) Inventors: Zhong-Jun Ma, ShenZhen (CN); Nan Hu, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/322,235

(22) Filed: Jan. 29, 2009

(65) Prior Publication Data

US 2009/0191746 A1 Jul. 30, 2009

(30) Foreign Application Priority Data

Jan. 29, 2008 (CN) ..... 2008 2 0031808 U

(51) Int. Cl.
*H01R 13/627* (2006.01)

(52) U.S. Cl. ..... 439/350

(58) Field of Classification Search ..... 439/159–160, 439/630, 350, 377
See application file for complete search history.

(56) References Cited

U.S. PATENT DOCUMENTS

| | | | | |
|---|---|---|---|---|
| 6,951,470 | B1 * | 10/2005 | Huang | 439/159 |
| 7,059,911 | B2 | 6/2006 | Uchida et al. | |
| 7,112,075 | B1 * | 9/2006 | Su | 439/159 |
| 2002/0160661 | A1 * | 10/2002 | Florescu | 439/630 |

* cited by examiner

*Primary Examiner*—Jean Duverne
(74) *Attorney, Agent, or Firm*—Ming Chieh Chang; Wei Te Chung; Andrew C. Cheng

(57) ABSTRACT

An electrical card connector (100) includes an insulating housing (10), a metal shield (30) defining a plurality of channels (110, 142, 141), a terminal module (20) with a plurality of contacts (21) received therein and a clip. The metal shield shields over the insulating housing for defining a card receiving space. The clip includes a pair of first elastic pieces (40) and a second elastic piece (50). The first elastic piece forms a first contact portion (42) and a second contact portion (41). The first contact portion protrudes into the card receiving space for connecting with an inserted card (70). The second elastic piece forms a flexible arm (51) interfering with the second contact portion.

7 Claims, 7 Drawing Sheets

ELECTRICAL CARD CONNECTOR HAVING CLIPS TO INCREASE RETAINING FORCE FOR CARDS

BACKGROUND OF THE INVENTION

1. Field of the Invention

The present invention relates generally to electrical card connectors, and more particularly to an electrical card connector having clips to increase retaining force for cards inserted therein.

2. Description of Related Arts

IC cards have been developed and a type of IC card called a subscriber identification module card (SIM card) is used in cellular phones as an identification and storage unit for subscriber related data. A SIM card normally includes a terminal array for connection through a SIM card connector to the external equipment.

A SIM card connector usually includes a card socket for receiving the SIM card and a plurality of resilient contacts for engaging the terminal array of the card when the card is inserted into the card socket. The card connector usually includes retaining elements for providing retaining force to the card, so the card is prevented from shaking away from one side to the other in the card socket. Accordingly, a reliable electrical connection between the card and the card connector is achieved and information therebetween is effectively and correctly transferred thereafter.

A conventional SIM card connector usually includes a covering shield moveably covering a base thereof and forming a card socket. The covering shield slides relative to the base along a card insertion direction and a card received in the covering shield achieves a mechanical and electrical connection with the contacts, while the covering shield slides along an opposite direction, the card is divorced from the contacts of the card connector. Because the covering shield is made of metal material, the card is rigidly connected with the covering shield which may destroy to the card.

Hence, an improved electrical card connector is desired.

SUMMARY OF THE INVENTION

Accordingly, an object of the present invention is to provide an electrical card connector having clips to increase retaining force for cards.

To achieve the above object, an electrical card connector includes an insulating housing, a metal shield defining a plurality of channels, a terminal module with a plurality of contacts received therein and a clip. The metal shield shields over the insulating housing for defining a card receiving space. The clip includes a pair of first elastic pieces and a second elastic piece. The first elastic piece forms a first contact portion and a second contact portion. The first contact portion protrudes into the card receiving space to connect with an inserted card. The second elastic piece forms a flexible arm interfering with the second contact portion.

Other objects, advantages and novel features of the invention will become more apparent from the following detailed description when taken in conjunction with the accompanying drawings.

DETAILED DESCRIPTION OF THE PREFERRED EMBODIMENT

Figure 1:
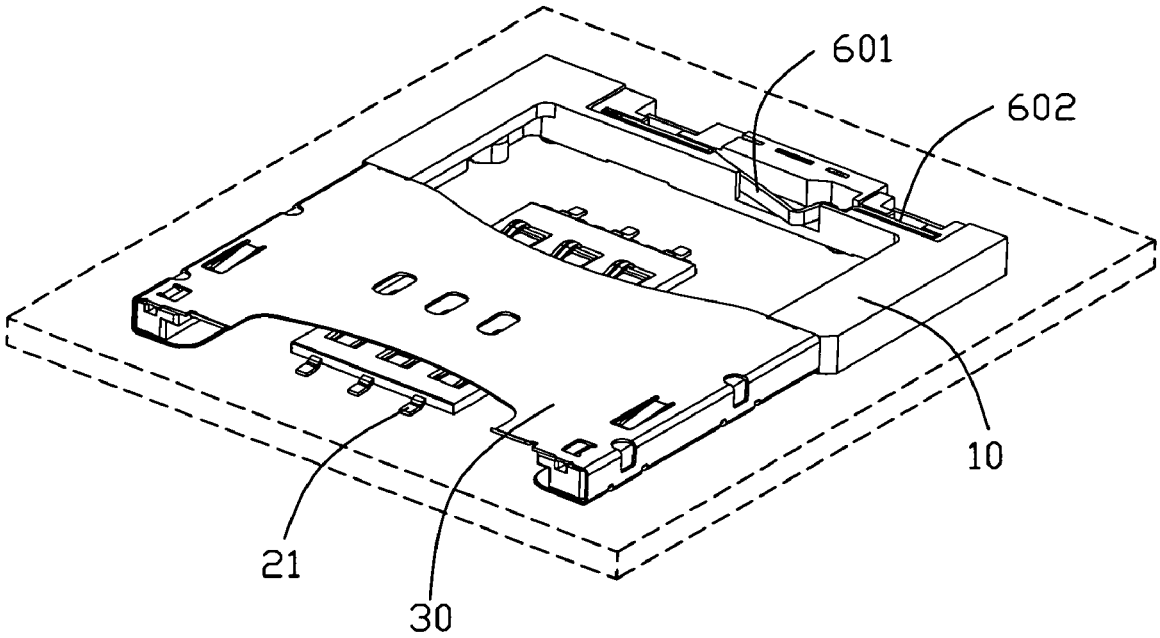
FIG. 1 is a perspective, assembled view of an electrical card connector according to the present invention.

FIGS. 1-7 illustrate an electrical card connector 100 in accordance with the present invention, assembled on a printed circuit board (PCB) (described in broken lines of FIG. 1) and comprising an insulating housing 10, a terminal module 20 with a plurality of contacts 21 received therein, a metal shield 30 assembled on and partly shielding over the insulating housing 10 for defining a card receiving space (not labeled), a pair of first elastic pieces 40, a second elastic piece 50 and a switch element 60. The first elastic pieces 40, the second elastic piece 50 and the switch element 60 are all received in the insulating housing 10. The first elastic pieces 40 and the second elastic piece 50 are defined as a clip (not labeled) for increasing retaining force for electrical cards.

Figure 4:
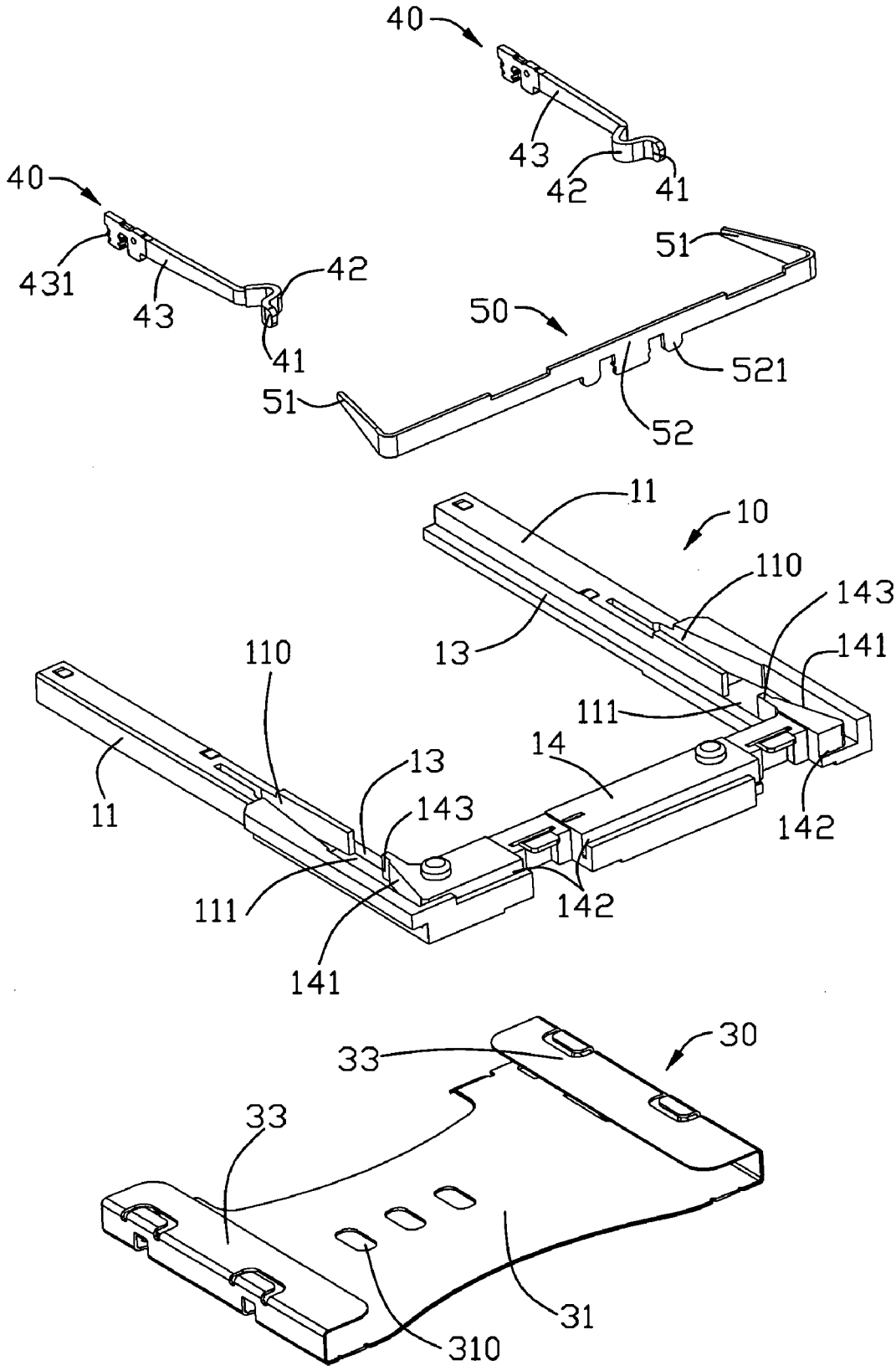
FIG. 4 is a perspective, partly exploded view of the electrical card connector.
Figure 5:
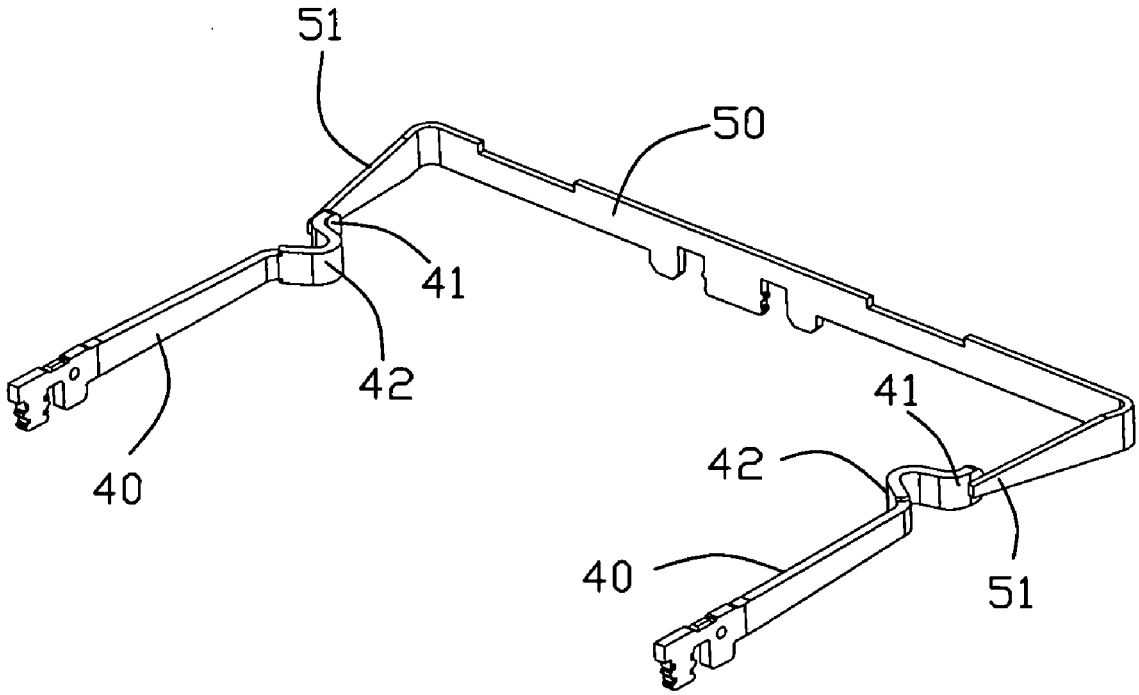
FIG. 5 is a perspective view of the elastic pieces of the electrical card connector.
Figure 6:
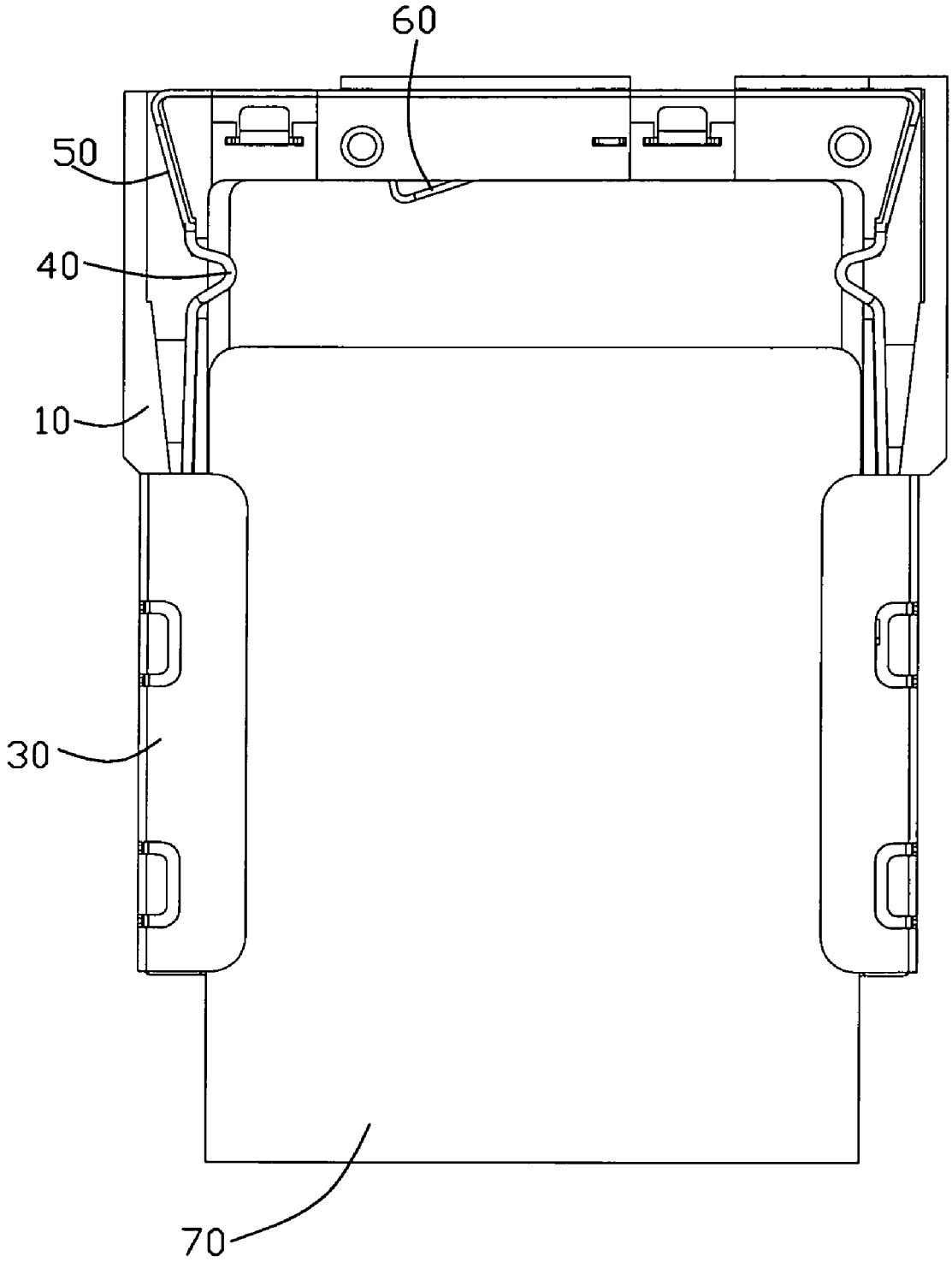
FIG. 6 is a top view of an electrical card and the electrical card connector into which the electrical card is not fully inserted into.
Figure 7:
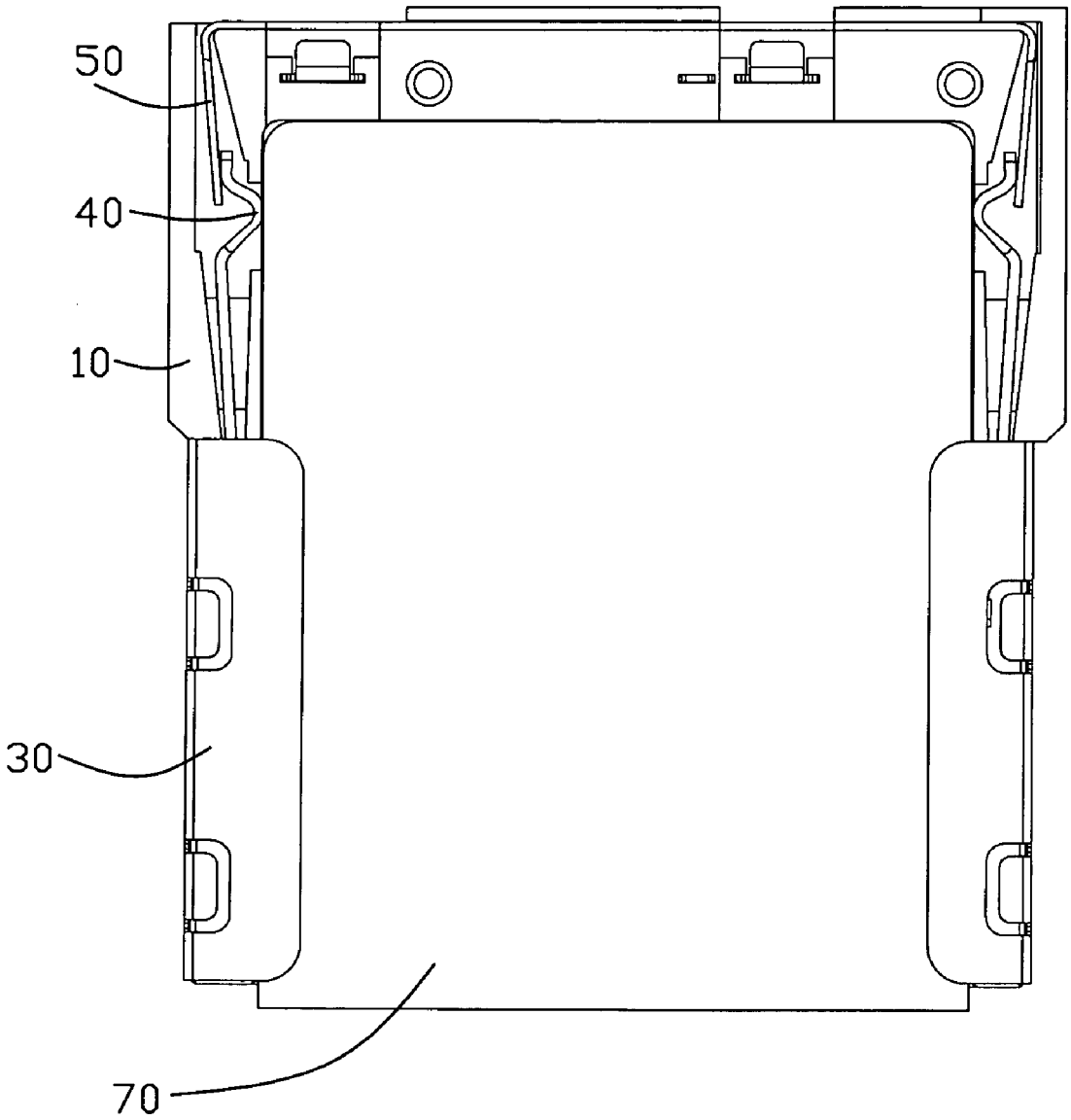
FIG. 7 is a top view of the electrical card and the electrical card connector into which the electrical card is fully inserted into.

Referring to FIGS. 4-5, the first elastic piece 40 of the clip forms a main portion 43, a first contact portion 42 curvedly extending from one end of the main portion 43 and a second contact portion 41 extending from a free end of the first contact portion 42. The main portion 43 forms a plurality of fixing portions 431 for orientation of the first elastic piece 40. The second elastic piece 50 of the clip forms a lengthwise arm 52 and a pair of flexible arms 51 extending from two ends of the lengthwise arm 52. The lengthwise arm 52 forms a plurality of retaining portions 521 for orientation of the second elastic piece 50. The flexible arms 51 deflect towards each other, i.e. the flexible arm 51 and the lengthwise arm 52 defines an angle less than 90°. In a preferred embodiment, the flexible arm 51 is taper-shaped. However, a figure of the flexible arm 51 is not limiting, other figures of the flexible arm 51 are also feasible.

Figure 2:
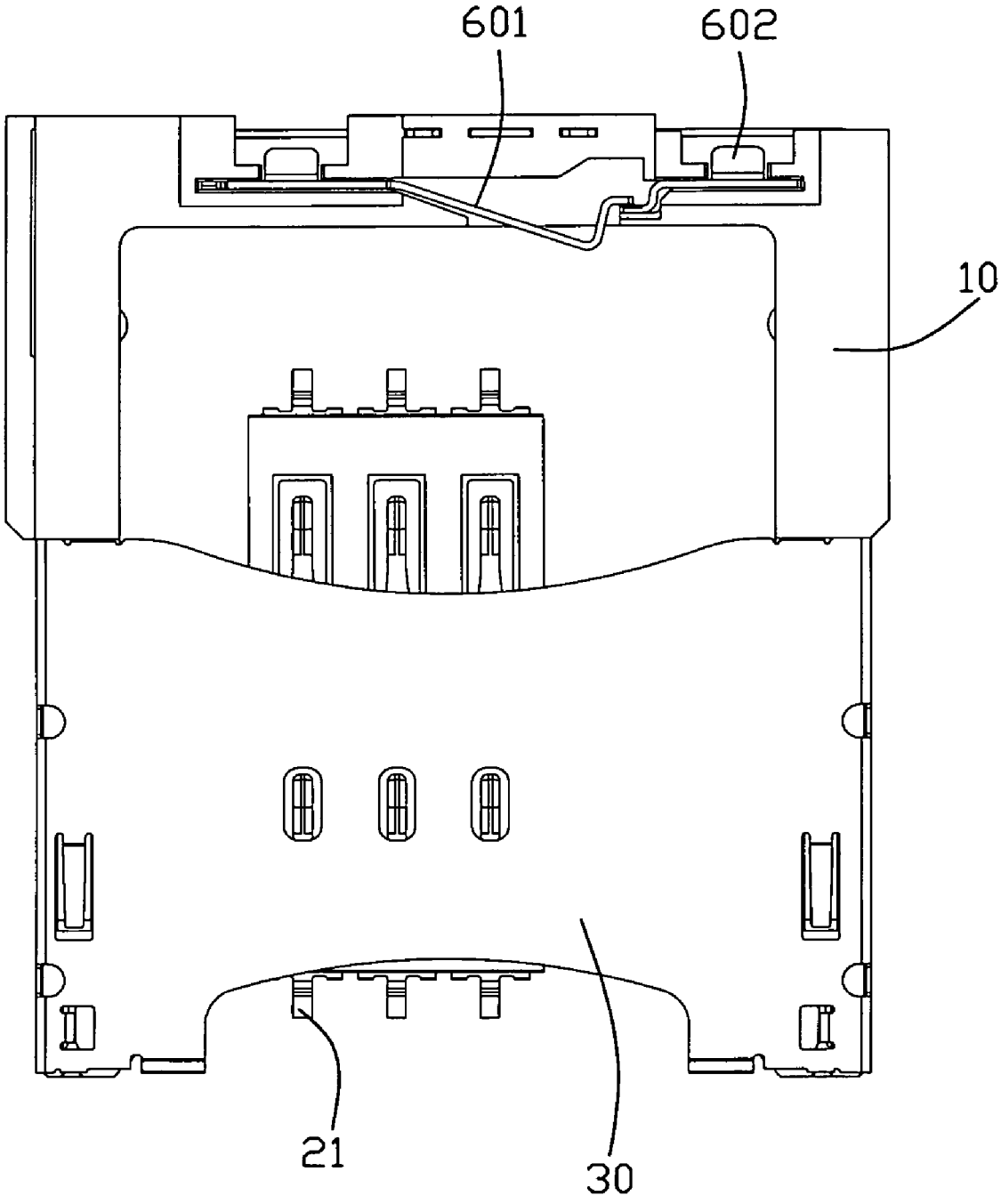
FIG. 2 is a top plan view of the electrical card connector.
Figure 3:
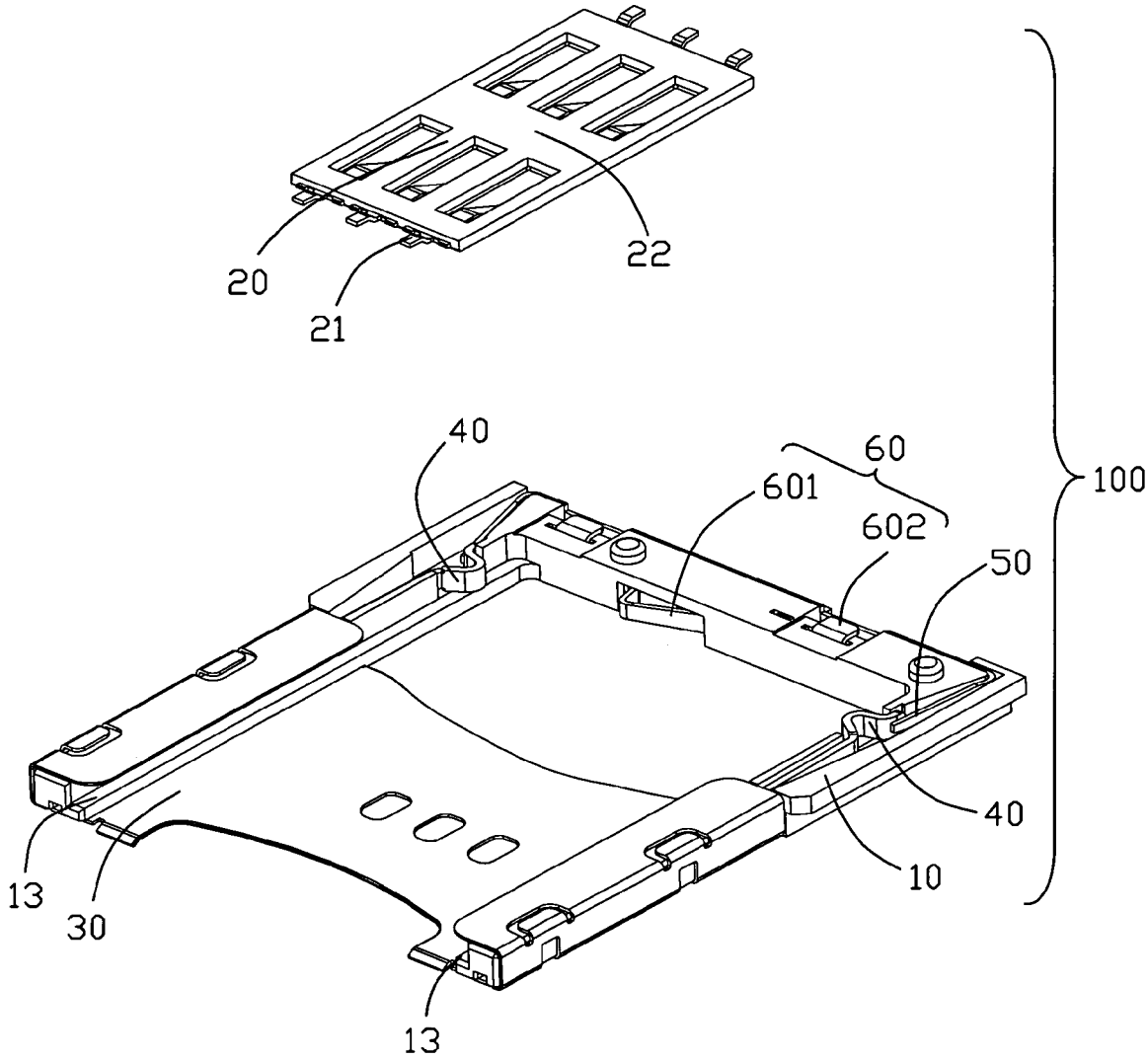
FIG. 3 is a perspective, exploded view of an electrical card connector.

Referring to FIG. 2, the insulating housing 10 comprises a transversal wall 14 and a pair of longitudinal walls 11 integrated with the transversal wall 14. Each longitudinal wall 11 defines a first receiving channel 110 for receiving the first elastic piece 40. The transverse arm 14 defines a second receiving channel 142 for receiving the lengthwise arm 52 of the second elastic piece 50. In this embodiment, the second receiving channel 142 is disconnected. However, a second alternative embodiment of connective second receiving channel 142 is feasible. A connecting channel 141 is defined at a jointing corner of the transversal wall 14 and the longitudinal wall 11 for communicating with each first receiving channel 110 and the second receiving channel 142. The connecting channel 141 is used for receiving the flexible arm 51 of the second elastic piece 50. The connecting channel 141 has different widths, a first end thereof communicating with the second receiving channel 142 is a little narrower and a second end thereof communicating with the first receiving channel 110 is a little wider. The insulating housing 10 defines a cutout 111 with opening towards the card receiving space, which is adjacent to the second end of the connecting channel 141. A supporting surface 143 is formed adjacent to the second end of the connecting channel 141 too, i.e., beside the cutout 111. The longitudinal wall 11 further comprises a guiding portion 13 adjacent to the card receiving space.

The first contact portion 42 protrudes into the card receiving space through the cutout 111 and the second contact portion 41 abuts against the supporting surface 143 when the first elastic piece 40 is received in the first receiving channel 110 and is fixed with the insulating housing 10 by virtue of the fixing portions 431. The flexible arm 51 contacts with the second contact portion 41 of the first elastic piece 40 when the flexible arm 51 is received in the connecting channel 141 and correspondingly the lengthwise arm 52 of the second elastic piece 50 is received in the second receiving channel 142. Furthermore, the second elastic piece 50 is fixed with the insulating housing 10 by virtue of the retaining portions 521.

The switch element 60 is received in the specific receiving channel (not labeled) of the transversal wall 14 and comprises a movable piece 601 and a stationary piece 602 contacted with the movable piece 601 when a card is not inserted in the card receiving space. The movable piece 601 has an arch portion protruding into the card receiving space to be pressed against the inserted card and a mating interface located behind that of the stationary piece 602, which makes detachment between the movable piece 601 and the stationary piece 602 when the card is inserted in the card receiving space.

The metal shield 30 comprises a flat portion 31 and a pair of bending portions 33 extending from two edges of the flat portion 31 for shielding over the longitudinal walls 11 of the insulating housing 10 and so, the metal shield 30 is assembled on the insulating housing 10 for ESD. The flat portion 31 defines a row of through holes 310 at an approximately middle part thereof.

The terminal module 20 forms an insulated base 22. The contacts 21 are arranged in two rows and received in the insulated base 22.

In use, an inserted card (70) is inserted into the card receiving space under the guidance of the guiding portion 13 of the insulating housing 10. The inserted card (70) contacts with and presses on the first contact portions 42 of the first elastic pieces 40 to drive the second contact portions 41 to press against the flexible arms 51 of the second elastic piece 50 outwardly. Because of elasticity of the flexible arms 51, the flexible arms 51 press against the second contact portions 41 reversely to act on the inserted card (70) and so, to provide retaining force for the inserted card (70). The inserted card (70) is prevented from shifting away from one side to the other in the card socket of course. The electrical connection between the inserted card (70) and the contacts 21 is achieved when the inserted card (70) presses the movable piece 601 of the switch element 60 to separate from the stationary piece 602. The first elastic piece 40 bears against the second elastic piece 50 along a direction perpendicular to the card insertion direction, while the movable piece 601 moves away from the stationary piece 602 of the switch element 60 along the card insertion direction. The through holes 310 of the metal shield 30 are just located above the contacts 21 for orientating the metal shield 30 relative to the terminal module 20.

While a preferred embodiment in accordance with the present invention has been shown and described, equivalent modifications and changes known to persons skilled in the art according to the spirit of the present invention are considered within the scope of the present invention as described in the appended claims.

We claim:

1. An electrical card connector comprising:

an insulating housing defining a plurality of channels;

a metal shield shielding over the insulating housing for defining a card receiving space;

a terminal module with a plurality of contacts received therein; and a clip having a pair of first elastic pieces and a second elastic piece received in the corresponding channels, each first elastic piece forming a first contact portion and a second contact portion, the first contact portion protruding into the card receiving space for connecting with an inserted card, the second elastic piece forming a flexible arm interfering with the second contact portion wherein the insulating housing comprises a transversal wall and a pair of longitudinal walls integral with the transversal wall, and each longitudinal wall defines a first receiving channel to receive the first elastic piece; wherein the transversal wall defines a second receiving channel and the second elastic piece forms a lengthwise arm to be received in the second receiving channel; wherein the insulating housing defines a connecting channel communicating the first and second receiving channels and the flexible arm is received in the connecting channel; wherein the connecting channel defines a first end communicating with the second receiving channel and a second end communicating with the first receiving channel, and the first end is narrower than the second end; wherein a supporting surface is formed adjacent to the second end of the connecting channel; wherein the insulating housing defines a cutout with opening towards the card receiving space and adjacent to the supporting surface; wherein the first contact portion of the first elastic piece protrudes into the card receiving space through the cutout and the second contact portion abuts against the supporting surface.

2. The electrical card connector as described in claim 1, wherein the flexible arm is taper-shaped.

3. The electrical card connector as described in claim 1, wherein the flexible arm and the lengthwise arm defines an acute angle.

4. The electrical card connector as described in claim 1, wherein the first elastic piece forms fixing portions fixed with the longitudinal wall and the second elastic piece forms retaining portions fixed with the transversal wall.

5. The electrical card connector as described in claim 1, wherein a switch element is received in the transversal wall.

6. The electrical card connector as described in claim 5, wherein the switch element comprises a movable piece and a stationary piece separated from the movable piece by virtue of the inserted card.

7. The electrical card connector as described in claim 1, wherein the contacts are arranged in two rows and the metal shield defines a row of through holes located above one row of the contacts.

* * * * *